US005375961A

United States Patent [19]

Mojden et al.

[11] Patent Number: 5,375,961

[45] Date of Patent: Dec. 27, 1994

[54] APPARATUS AND METHOD FOR DEBAGGING ARTICLES

[75] Inventors: Daniel R. Mojden, Clarendon Hills; Thomas E. Close, Jr., Shorewood, both of Ill.

[73] Assignee: Fleetwood Systems, Inc., Countryside, Ill.

[21] Appl. No.: 60,199

[22] Filed: May 7, 1993

[51] Int. Cl.[5] ..... B65B 69/00

[52] U.S. Cl. ..... 414/412; 414/417; 414/786

[58] Field of Search ..... 414/411, 412, 786, 417; 53/384.1

[56] References Cited

U.S. PATENT DOCUMENTS

| | | | |
|---|---|---|---|
| 3,686,820 | 8/1972 | Zenger et al. | 414/412 X |
| 3,722,741 | 3/1973 | Mojden | 221/11 |
| 3,777,913 | 12/1973 | Schieser et al. | 414/411 X |
| 4,143,779 | 3/1979 | Hachikawa et al. | 414/411 |
| 4,158,417 | 6/1979 | Inoue | 414/412 |
| 4,245,946 | 1/1981 | McCullough et al. | 414/412 |
| 4,580,938 | 4/1986 | Mojden et al. | 414/119 |
| 4,681,507 | 7/1987 | Mojden et al. | 414/412 X |
| 4,938,649 | 7/1990 | ter Horst et al. | 414/412 |
| 4,995,771 | 2/1991 | Sedgeley et al. | 414/412 |
| 4,997,329 | 3/1991 | Hanomoto et al. | 414/412 |
| 5,275,524 | 1/1994 | Ishiwata | 414/412 |

FOREIGN PATENT DOCUMENTS

| | | | |
|---|---|---|---|
| 0045864 | 3/1984 | Japan | 414/411 |
| 1012271 | 1/1986 | Japan | 414/411 |
| 4352627 | 12/1992 | Japan | 414/412 |
| 4352628 | 12/1992 | Japan | 414/412 |

*Primary Examiner*—Michael S. Huppert
*Assistant Examiner*—James W. Keenan
*Attorney, Agent, or Firm*—Trexler, Bushnell, Giangiorgi & Blackstone, Ltd.

[57] ABSTRACT

The invention provides a method and apparatus for debagging a stack of articles such as can ends and the like which are arranged in a facewise stacked condition in an elongate tubular bag. The method comprises the steps of engaging one end of the bag and then pulling the bag in an axial direction for removing it from the stack of articles while simultaneously retaining the articles in such a manner as to prevent axial movement thereof to a degree sufficient to disengage any of the articles from their facewise stacked condition in response to the axial movement of the bag. The invention also provides novel apparatus for carrying out this method.

17 Claims, 7 Drawing Sheets

APPARATUS AND METHOD FOR DEBAGGING ARTICLES

BACKGROUND OF THE INVENTION

This invention relates to methods and apparatus for automated article handling, and particularly concerns a method and apparatus for debagging articles such as can ends and the like.

Two-piece and three-piece can-type containers are widely used for packaging beverages, food products, petroleum products and a great number of other products. In the packaging of these products, it is common to provide the packaging machinery with a supply of can bodies and with a separate supply of pre-formed can ends. In many applications, and particularly in beverage packaging, it is common to provide a can end with a pull tab closure for ease of opening by the consumer.

The can ends are usually provided to the packaging machinery stacked in facewise relation in elongated stacks or groups, each of a predetermined and controlled number. These stacks are usually delivered to the packaging plant in elongated kraft paper bags which protect the can ends against dirt and contamination during handling and transport.

The packaging and closure activity occurs at a relatively high rate of speed, as high as perhaps hundreds of containers being filled and having their closures or ends applied per minute. As such, it is necessary to provide a large number of can ends at a relatively high speed. Advantageously, an effectively endless supply of can ends can be provided by a rotary or carousel type infeed or feeder unit or device of the type generally shown and described in U.S. Pat. No. 3,722,741 which is commonly owned herewith. The carousel type infeed unit shown in this U.S. patent employs a plurality of individual pockets for receiving and storing individual stacks of ends preparatory to delivery of the ends to the filling and closure machinery.

Before the stacks of can ends can be supplied to the filling and closure machinery, the kraft paper bags must be removed. The removal of these bags has heretofore been accomplished by hand, in that a bag of ends is placed in a pocket of the rotary infeed unit and the bag is then manually stripped from the stack of can ends. One previous mechanical device for automatically debagging stacks of can ends is shown in U.S. Pat. No. 4,245,946. Another device for automatically debagging can ends is shown in U.S. Pat. Nos. 4,580,938 and 4,681,507 which are commonly owned herewith. However, there remains room for yet further improvement.

In particular, it is desirable to provide a debagging method and apparatus can readily be employed with, and preferably retrofitted to, existing carousel or rotary-type infeed units of the type mentioned above, and as described in U.S. Pat. No. 3,722,741, without requiring modification to the carousel or rotary-type infeed unit.

One particular problem which arises when removing the elongated kraft paper bags from stacks of can ends is that of movement of one or more of the can ends out of their facewise stacked condition. More particularly, there is a tendency for the topmost end or ends of the stack to be tilted, canted or even completely flipped over during removal of the bag. This is due to frictional engagement of the topmost ends with the bag as the bag is pulled in an axial direction for removal. In particular, as the open end portion of the bag clears the topmost ends of the stack, there is a tendency of these topmost ends to be frictionally engaged by the end part of the bag to such an extent that they can be tilted, canted or actually flipped over 180°.

This condition is to be avoided, as the feeding of a reversely oriented can end to the filling and closure machinery can disrupt the highly automated, high speed filling and closure operation. Such disruptions or delays can be quite costly in terms of downtime of relatively large, highly automated lines. Moreover, when one piece of equipment in such an automated system must be shut down, other related equipment in the system often must also be shut down until the problem is corrected. Such delays are to be avoided as they are expensive in terms of the shutdown time of the equipment and of the overall packaging operation.

OBJECTS AND SUMMARY OF THE INVENTION

Accordingly, it is a general object of the invention to provide a novel and improved method and apparatus for debagging can ends and like articles.

A related object is to provide a method and apparatus in accordance with the foregoing object which can readily be employed to debag can ends or like articles located within the pockets of a rotary or carousel-type infeed device.

A related object is to provide an apparatus in accordance with the foregoing objects which can readily be retrofitted to existing rotary or carousel-type infeed devices.

A further object is to provide an apparatus in accordance with the foregoing objects which overcomes the above-noted problems.

Briefly, and in accordance with the foregoing objects, the present invention provides a method and apparatus for debagging a stack of articles such as can ends and the like which are arranged in a facewise stacked condition in an elongate tubular bag. The method comprises the steps of engaging one end of the bag and then pulling the bag in an axial direction for removing it from the stack of articles while simultaneously retaining the articles in such a manner as to prevent axial movement thereof to a degree sufficient to disengage any of the articles from their facewise stacked condition in response to the axial movement of the bag. The invention also provides novel apparatus for carrying out this method.

BRIEF DESCRIPTION OF THE DRAWINGS

The features of the present invention which are believed to be novel are set forth with particularity in the appended claims. The organization and manner of operation of the invention, together with further objects and advantages thereof may best be understood by reference to the following description, taken in connection with the accompanying drawing in which like reference numerals identify like elements, and in which:

DETAILED DESCRIPTION OF THE ILLUSTRATED EMBODIMENT

Figure 1:
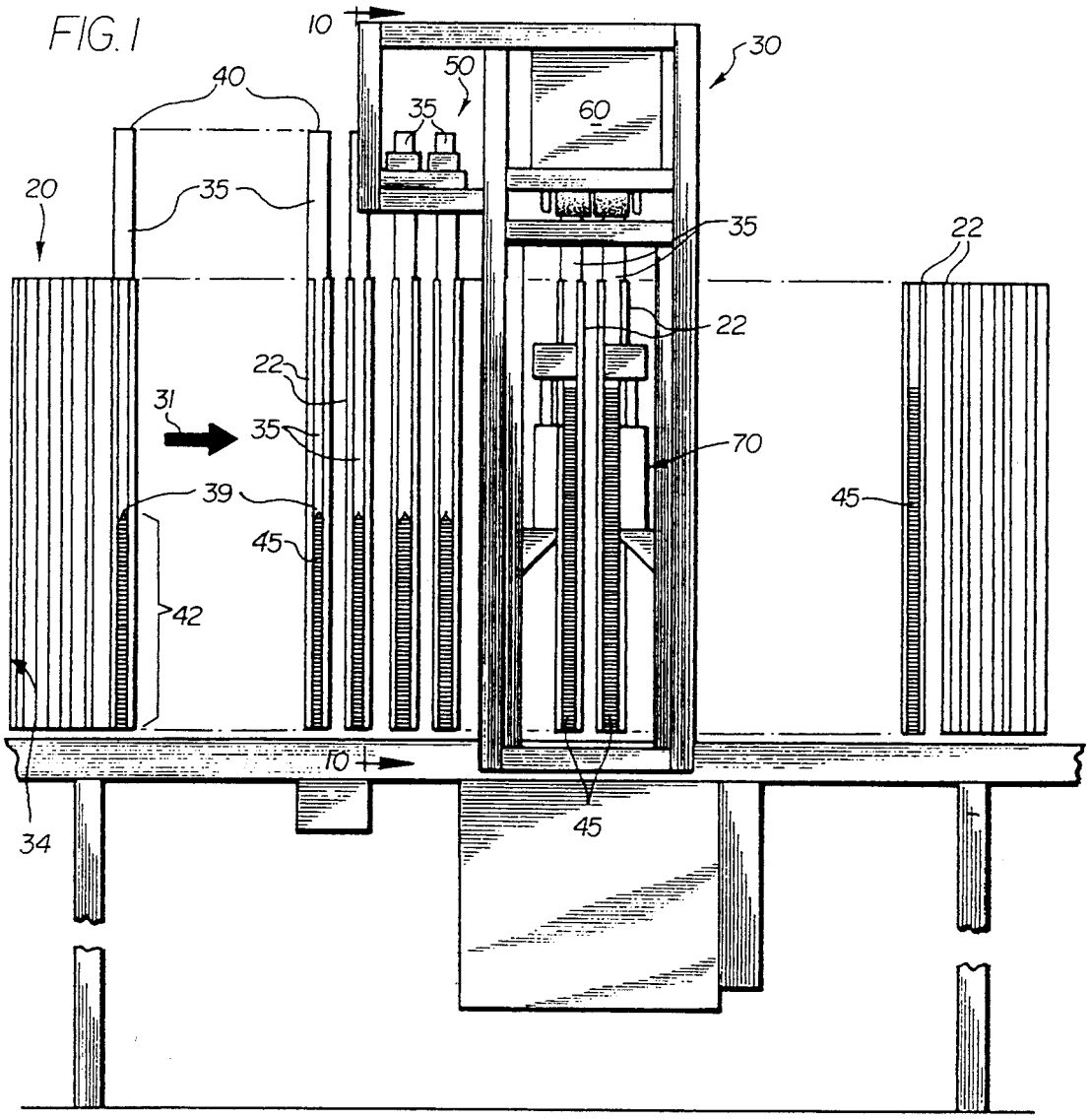
FIG. 1 is a side elevation, partially broken away, and somewhat diagrammatic in form, showing a rotary type feeder device which has been provided with a debagging apparatus in accordance with the invention.
Figure 2:
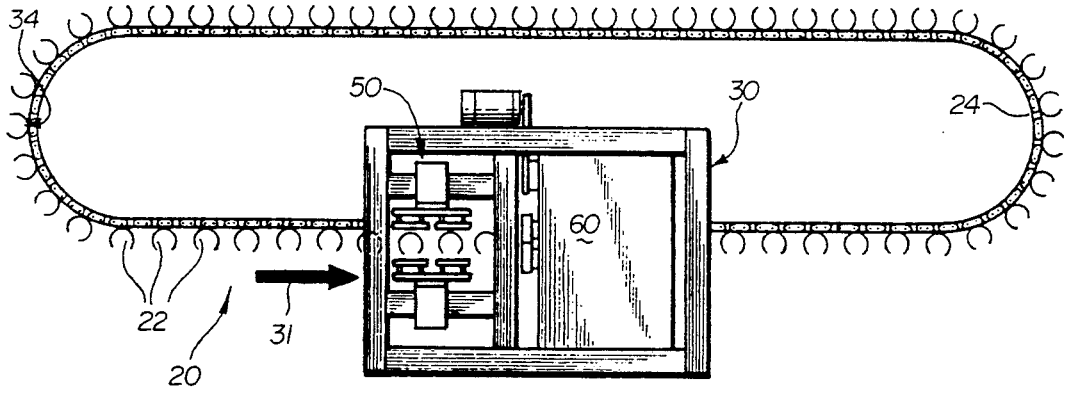
FIG. 2 is a simplified top plan view, also somewhat diagrammatic in form, also showing a rotary type feeder device which has been provided with a debagging apparatus in accordance with the invention.

Referring now to the drawings and initially to FIGS. 1 and 2, there is illustrated in somewhat diagrammatic form a rotary or carousel type feeder or infeed device of the type generally shown and described in the above-referenced U.S. Pat. No. 3,722,741, and here designated generally by the reference numeral 20. In accordance with the invention, the device 20 is provided with a novel debagger apparatus 30 for removing bags 35 from stacks 45 of articles such as can ends and the like which are arranged in a facewise stacked condition, and carried in individual pockets 22 of the device 20.

More particularly, the infeed apparatus 20 includes a plurality of elongate pockets 22 which are arranged to index about an elongate track 24 which may be a chain or belt, driven by a suitable motor and gears. As these pockets index about the track 24, they approach an outfeed or unloading position 34 at which articles carried in the pockets 22 are discharged. In the illustrated embodiment, the articles comprise can ends which are arranged in a facewise stacked condition, such that each of the pockets 22 as configured for holding one such stack 45 of articles. The device 20 thus provides an essentially endless supply of articles to its outfeed station 34, such that these articles may be used, for example, in a can or other container filling and closure type of operation.

Preferably, stacks of can ends are loaded into the pockets 22 at a point more or less immediately following the outfeed station 34 in the direction (arrow 31) of indexing of the apparatus 20. In this regard, stacks of ends may be loaded to the apparatus and unloaded at outfeed end 34 during the dwell time between indexing movements of the apparatus 20.

In accordance with the usual practice, the stacks 45 of articles or can ends are provided packaged in kraft paper bags 35, and an operator loads the bagged stacks 45 of articles into the pockets 22. Before the articles reach the outfeed station 34, these bags must be removed so that the articles can be individually used at some point following their discharge at outfeed station 34. Advantageously, the present invention provides a novel and improved method and apparatus for removing the bags 35 from the stacks 45 of articles while the same are being carried in the pockets 22 after their introduction by an operator and well prior to their arrival at outfeed station 34. To this end, the apparatus 30 in accordance with the invention is positioned at a point along the carousel type infeed device 20 just a few pockets "downstream" in the direction of indexing 31 of the device from the point at which operator initially loads the bagged articles into the pockets 22.

It is generally desired to remove the bags 35 in an axially upward direction so as to axially slidably remove the bags from the can ends or other articles in the pockets 22. As mentioned hereinabove, one problem encountered when removing the bags in this fashion is that one or more of the can ends toward the topmost end of the stack tend to become dislodged and tilted, canted or even flipped over 180° due to the frictional engagement with the bag, and particularly as the open lower end of the bag is pulled over and away from the uppermost can ends. In accordance with the present invention, an axial end portion of the bag is engaged and the bag is pulled in the axial direction for completely removing the bag from the stack of articles while simultaneously retaining the stack of articles in such a manner as to prevent axial movement thereof sufficient to disengage any of the articles from the stacked condition.

As more fully described hereinbelow, this is accomplished by subjecting a topmost end of the articles in the stack to a retaining force sufficient to prevent the articles from moving out of their facewise stacked condition. Preferably, this is done by engaging the topmost end of the stack of articles through the bag and holding the articles in their facewise engagement in the stack while the bag is being removed, while at the same time permitting the motion of the bag in the axial direction for removal. This engagement comprises pressing oppositely laterally inwardly upon the bag at an axial location just above a topmost end of the stack of articles with a force sufficient to hold the articles substantially in place during axial movement of the bag while yet freely permitting removal of the bag in the axial direction.

Figure 3:
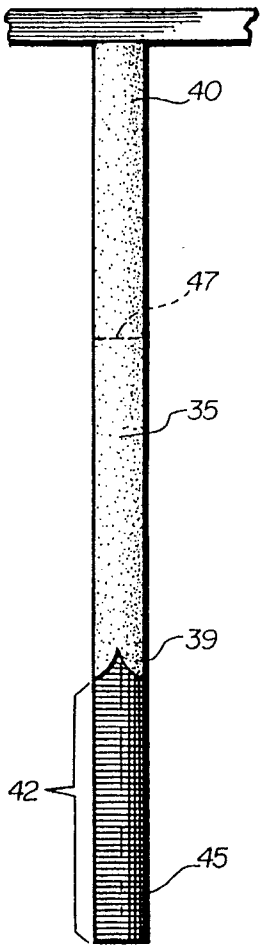
FIG. 3 is a somewhat diagrammatic side elevation illustrating a first step in a sequence of the debagging operation in accordance with the invention.

In accordance with the method of the invention, the operator initially opens the bottom end of each bag, in the event this bottom end is closed when the article-filled bag is introduced into a pocket 22. Typically, the bags are closed at their topmost end 40 and are folded over and/or taped shut at their bottom end 39. Accordingly, the operator removes the tape from the bottom end of the bag once the same has been introduced into a pocket 22. Thereupon the operator grasps a top end of the bag 35 and pulls the bag upwardly in the axial direction until the top end portion 40 of the bag 35 projects outwardly some distance beyond the stack of articles 45, thus leaving a corresponding portion 42 of the articles exposed at the bottom or open end 39 of the bag. Reference is also invited to FIG. 3 which also illustrates this initial pulling up of the bag.

Figure 6:
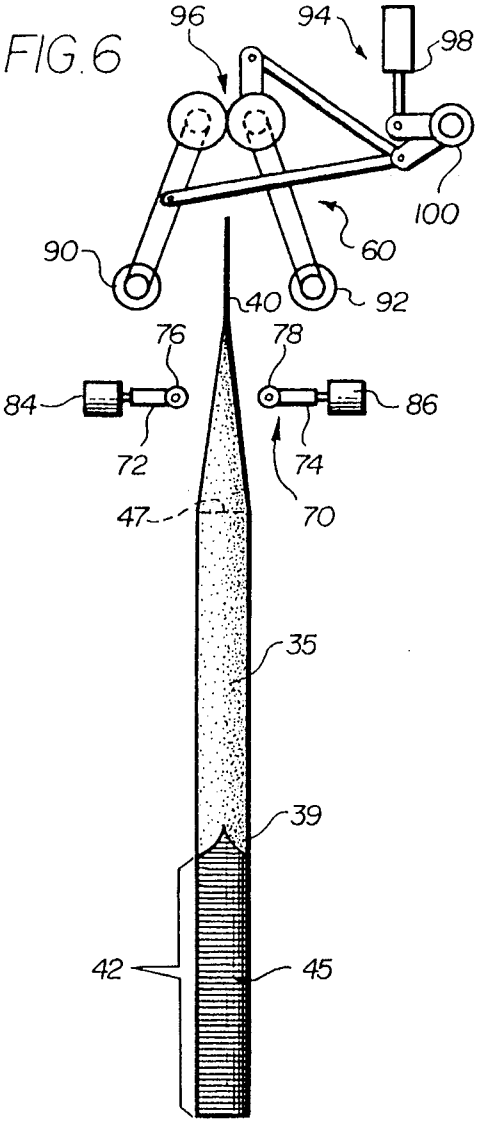
FIGS. 4–9 are simplified diagrammatic elevations showing a sequence of steps in the debagging operation and the related apparatus utilized in each of these steps.
Figure 5:
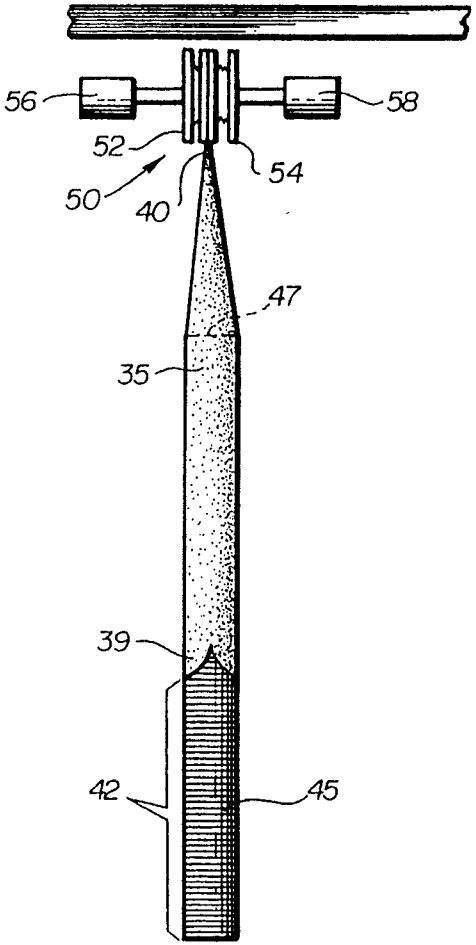
Figure 4:
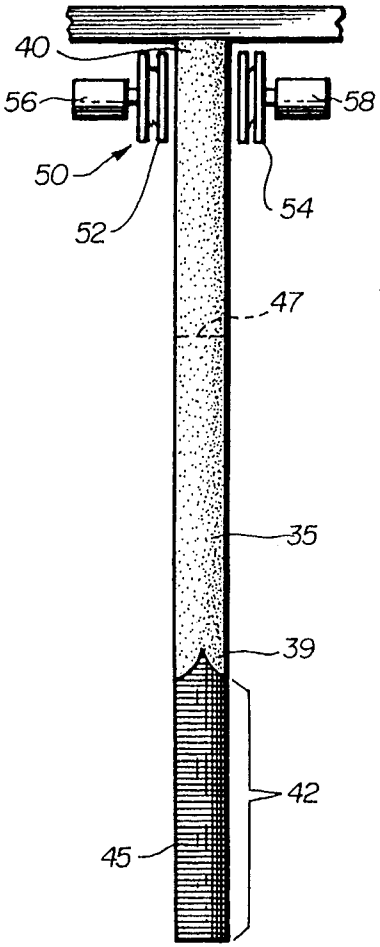

Having thus initially axially drawn up an end part 40 of the bag 35, the preferred method and apparatus of the invention next proceed as indicated in FIG. 6. However, referring first to FIGS. 4 and 5, an optional additional bag end flattening step and related apparatus may optionally be provided. In FIGS. 4 and 5, this optional portion of the apparatus of the invention is illustrated somewhat diagrammatically. This portion comprises a bag flattener means or assembly 50 for engaging and inwardly compressing the axial end portion 40 of the bag laterally inwardly to substantially flatten this outwardly projecting axial end portion 40 of the bag 35. This flattening operation is further illustrated in FIG. 5, wherein a second portion of this flattener 50 is shown. The bag flattener 50 includes a pair of parallel and spaced apart plates 52, 54 which are bidirectionally driven by respective associated piston and cylinder assemblies 56 and 58.

Referring now to FIGS. 6–9, the remaining steps, and associated apparatus, of the invention for removing the bag 35 from the stack of articles 45 are diagrammatically illustrated. As indicated in FIGS. 6–9, a bag removal means or assembly 60 engages the bag at its (optionally flattened) projecting end portion 40 and pulls the bag 35 in an axial direction until the bag is removed from the stack 45 of articles. In accordance with an important feature of the invention, simultaneously with this removal of the bag, an article retaining means or assembly 70 is provided for engaging the articles within the bag 35 in such a manner as to prevent axial movement of the articles sufficient to disengage any of the articles from their stacked condition while the bag is being removed from the stack of articles. Preferably, the article retaining means 70 comprise a pair of oppositely inwardly projecting members 72, 74 which in the preferred embodiment illustrated are provided at innermost facing ends thereof with freely rotating rollers 76, 78.

Figure 8:
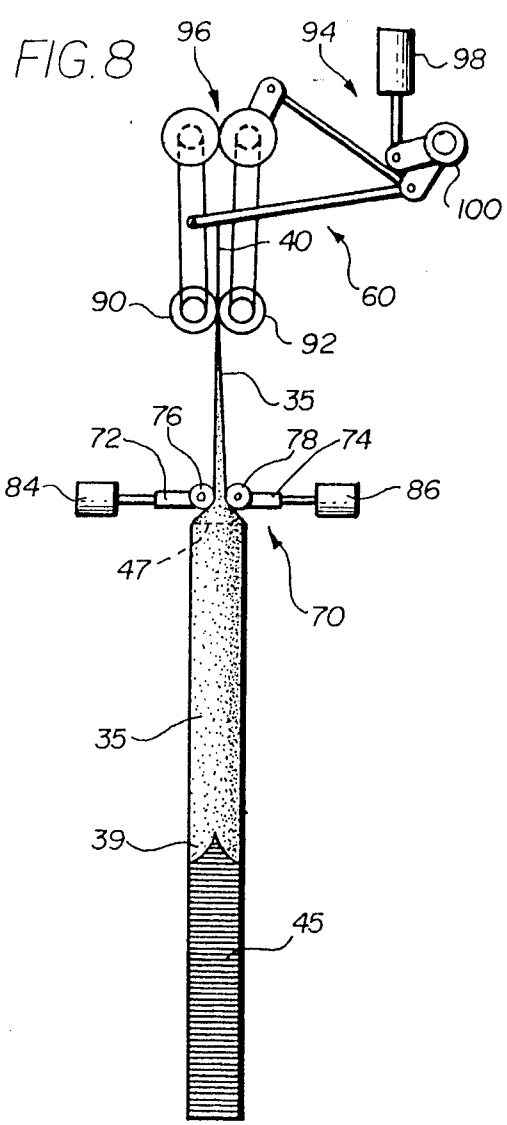

Axial operating means 80, 82 (see FIG. 10) are provided for axially moving members 72 and 74 bidirectionally between a rest position as illustrated in FIG. 6 and a position as illustrated in FIG. 8, just above a topmost end 47 within the bag 35. Additionally, lateral operating means 84, 86 are provided for moving the projecting members 72, 74 laterally inwardly and outwardly relative to the articles in the bag 35. This movement is between a first position wherein the members 72 and 74 are at a retracted or rest position as shown in FIGS. 6 and 7 to a second position as shown in FIG. 8 wherein the members 72 and 74 are advanced inwardly to at least partially overly the topmost one 47 of the articles within the bag 35.

Figure 9:
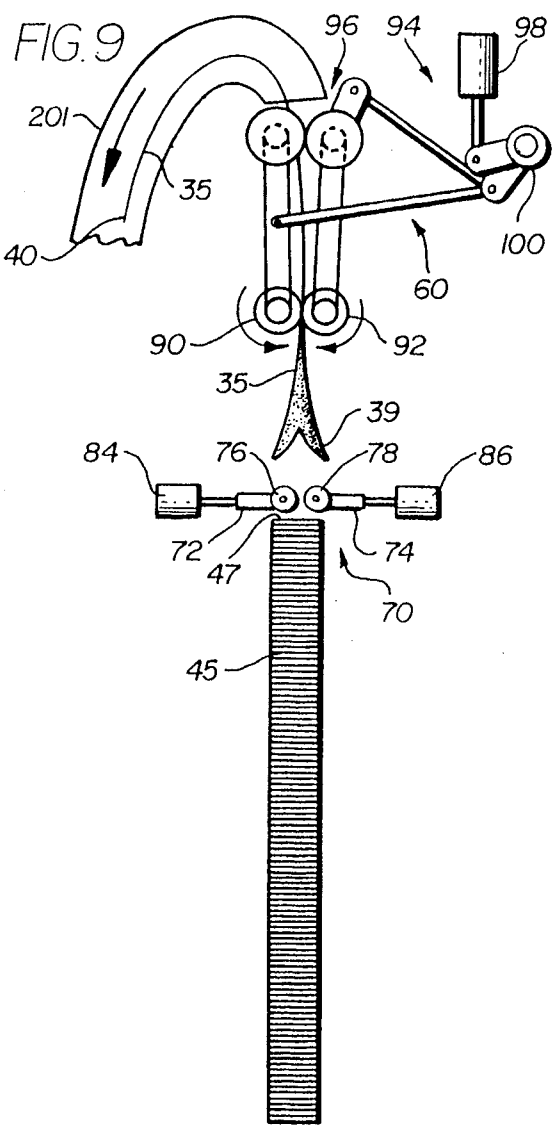
Figure 7:
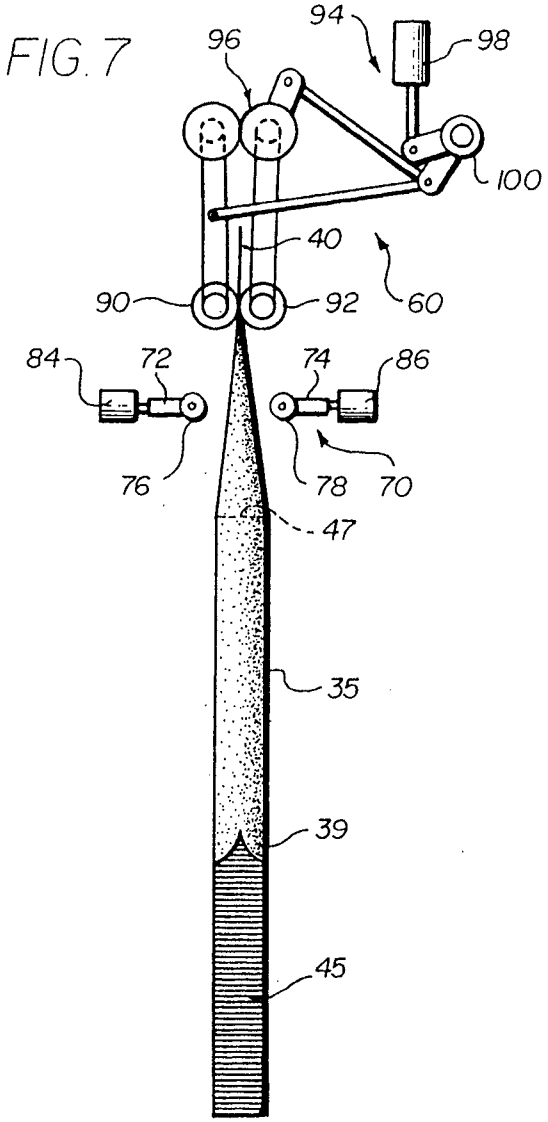

As shown in FIGS. 6–9, the bag removal assembly 60 comprises a pair of rollers 90, 92 and a movable mounting means or assembly 94 which mounts these rollers for bidirectional movement in a generally lateral direction between a first position shown in FIG. 6 wherein the rollers are laterally spaced apart to either side of the projecting end part 40 of the bag 35 to a second position as shown in FIGS. 7–9 wherein the rollers are moved laterally inwardly for engaging the end portion 40 of the bag 35.

In addition, a drive means or assembly 96, to be more fully described hereinbelow is provided for rotating the rollers 90, 92 in a direction for propelling a bag axially upwardly in a direction for removal from the stack 45 of articles. In the illustrated embodiment the mounting means or assembly 94 comprises a bidirectional drive means such as a piston and cylinder 98 and a linkage means or assembly 100 for coupling the bidirectional drive 98 for pivoting the rollers between their first and second positions as illustrated in FIGS. 6 and 7. Preferably, the drive means 96, as best viewed in FIGS. 10 and 14, comprises a motor 110 which is coupled by an appropriate assembly of belts, pulleys, gears and idlers, to be described more fully hereinbelow, to rotate the rollers 90 and 92. Upon operation of the motor 110 and related assembly, the rollers 90, 92 are rotated to propel the bag axially upwardly for complete removal relative to the stack 45 of articles as illustrated in FIG. 9.

As also shown in FIG. 9, a vacuum or suction tube or conduit 201 may also be provided to receive the bag 35 at the outlet of the rollers 90, 92 and convey the empty bag 35 to a container or compactor for disposal thereof.

Figure 10:
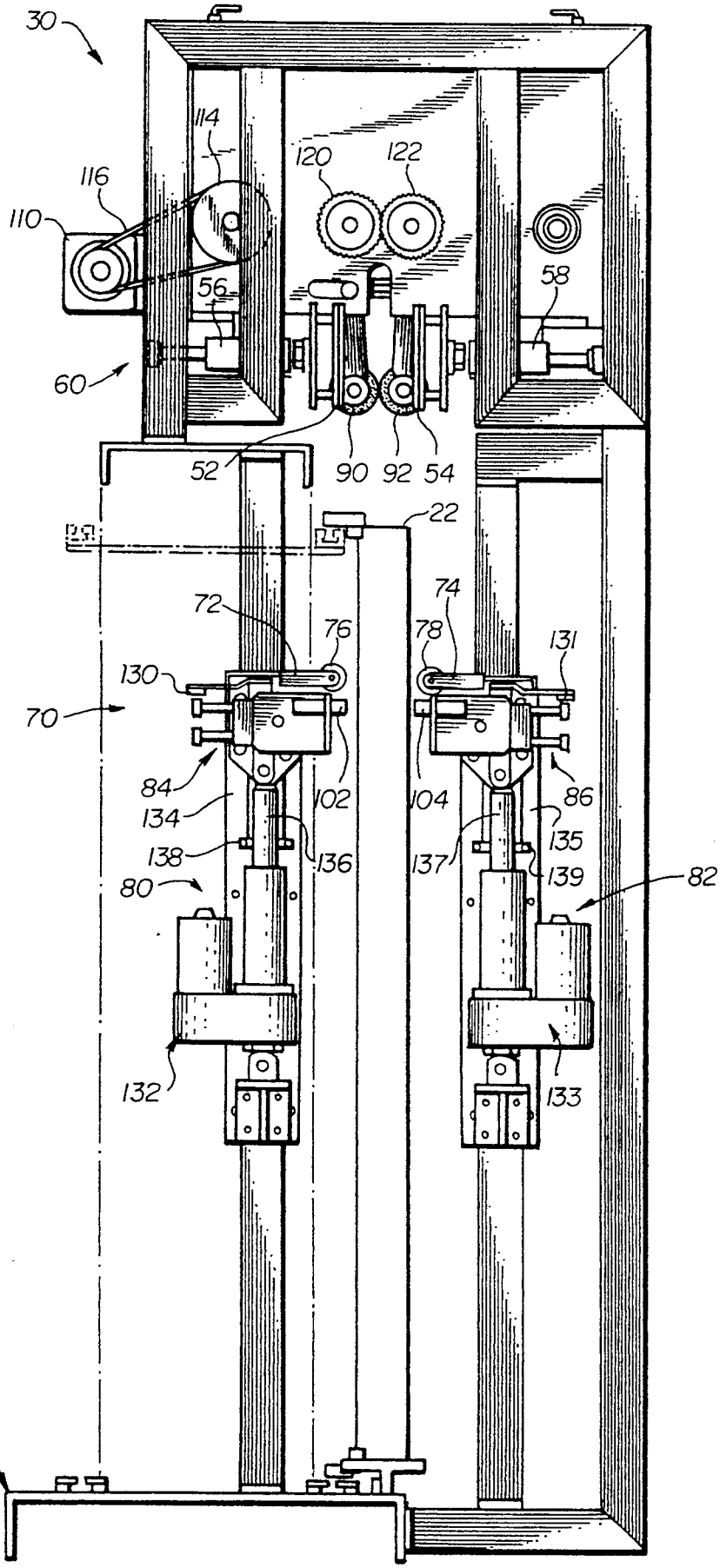
FIG. 10 is an end elevation of a debagging apparatus in accordance with an embodiment of the invention.
Figure 11:
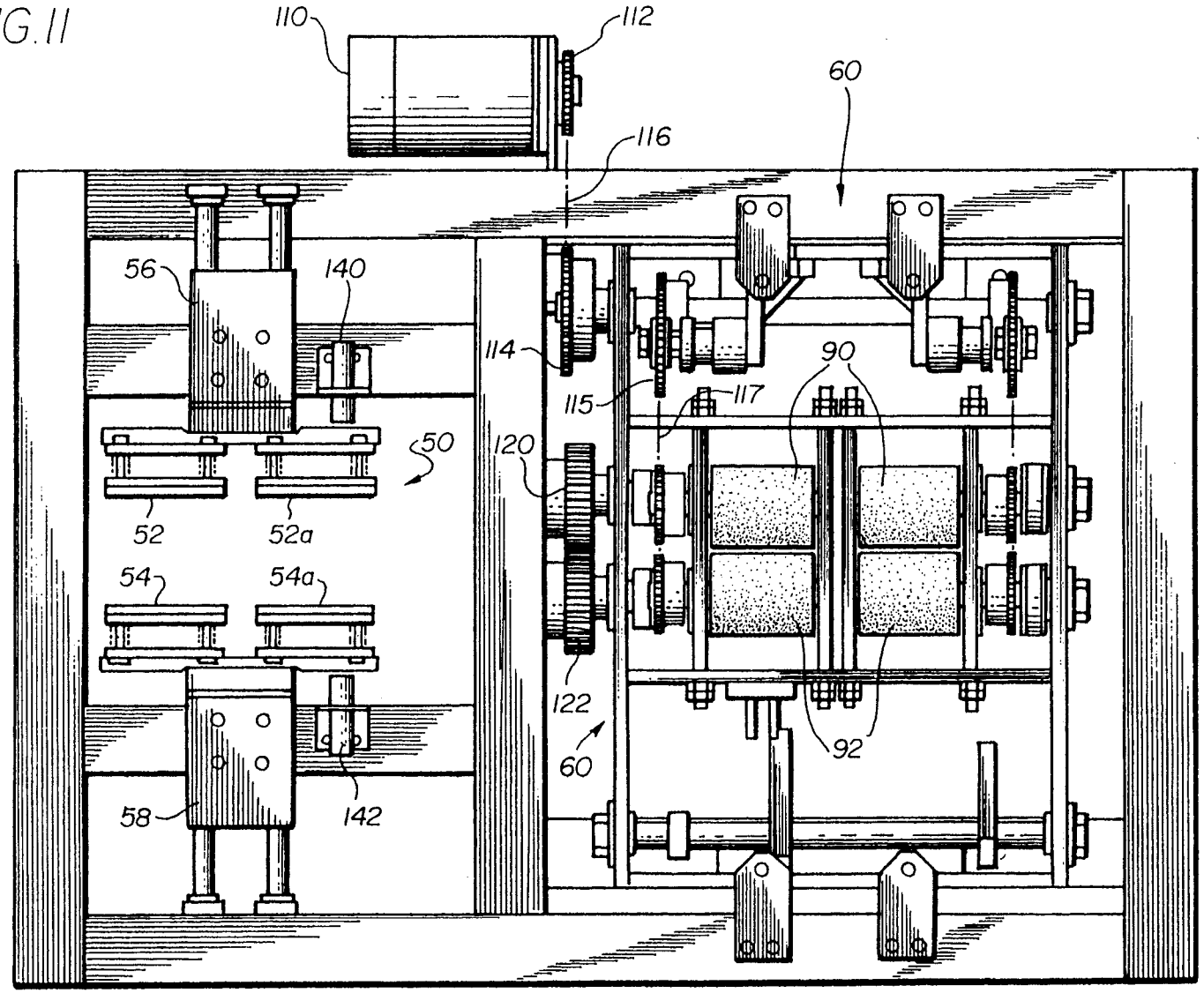
FIG. 11 is a top plan view of the apparatus of FIG. 10.
Figure 12:
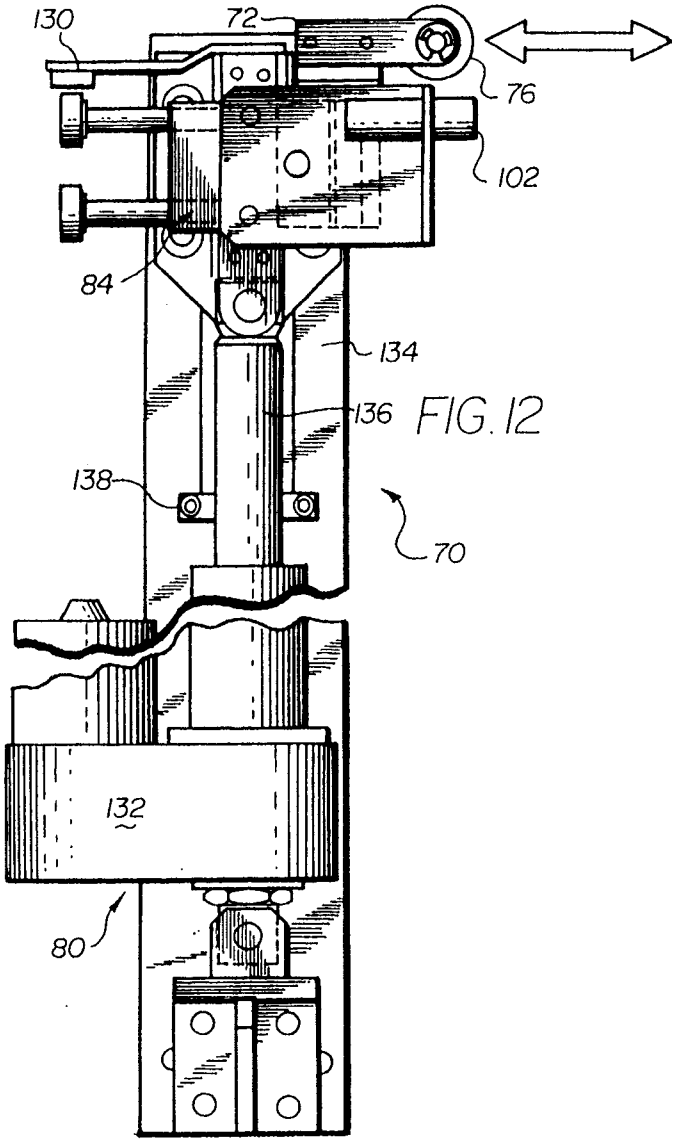
FIG. 12 is an enlarged elevation, partially broken away, of a portion of the apparatus of FIG. 10.

Reference is next invited to FIGS. 10–14 wherein further details of the apparatus described hereinabove are illustrated. Like reference numerals are used in FIGS. 10–14 to designate the like components described hereinabove with reference to FIGS. 1–9. Referring first to FIGS. 10 and 12, it is initially noted that FIG. 10 is a detailed view of the apparatus of the invention taken generally in the plane of the line 10—10 of FIG. 1. FIG. 12 is an enlarged view of one-half of the bag retaining assembly 70, it being understood that the other half is a mirror image thereof.

Sensing means 102, 104 are provided in connection with the article retaining members 72, 74 for sensing the axial location of a topmost end 47 of the articles within the bag 35 and producing the corresponding control signal. Preferably these sensing means take the form of proximity sensors. The axial operating means 80 and 82 are responsive to this control signal for moving the members 72, 74 to an axial location just above this topmost end 47 as illustrated in FIG. 8. Preferably, the article retaining members 72, 74 are moved laterally inwardly prior to being moved axially into engagement just over the topmost end 47 in the sequence illustrated respectively in FIGS. 6, 7 and 8.

It will be noted that the embodiment illustrated in FIGS. 10–14 utilizes two sets of the assemblies 50 and 70 of the type generally described above with reference to FIGS. 4–9, and rollers 90, 92 of sufficient axial length such that two bags are removed from two stacks of articles located in two adjacent ones of the pockets 22 simultaneously by the apparatus as illustrated in FIGS. 10–14. Accordingly, and referring briefly to FIG. 11, two sets of the optional flattening means or assemblies 52, 54 and **52*a*, 54*a* are illustrated. Similarly, two sets of bag removal roller assemblies 90, 92 are illustrated. It will also be noted that in the views of FIGS. 10 and 12, which are taken generally along the line 10—10 of FIG. 11, only one of each of these double sets of components is visible in this end elevation. As mentioned above, in FIG. 12, only one-half of the bag retaining means or assembly 70** has been illustrated, it being understood that the other half of this assembly is a substantially identical, mirror image thereof.

It will further be noted that each of the pockets 22 contains suitable through openings through which the respective projecting members 72, 74, their rollers 76, 78 and the associated sensors 102, 104 may project in operation to engage and overlie the topmost end 47 of the stack 45 as illustrated and described hereinabove with reference to FIGS. 6–9.

In the illustrated embodiment, the lateral operating means or assemblies 84, 86 comprise "PHD" powered slide members of the type designated 1½" stroke #SA032-1½-Q. The sensors 102, 104 comprise proximity sensors of the type generally designated "TURCK" proximity sensor-18 mm (10–30 vdc) #Bi5U-M18-AP6X-H1141. In the illustrated embodiment there are also provided sensors 130, 131 for determining the position of the lateral operating means 84, 86 and these sensors take the form of proximity type sensors which preferably comprise a "TURCK" thin-pac SENSOR (10–30 vdc pnp) #Bi5-Q08-AP6X2-V1131.

The axial operating means 80, 82 include a linear actuator 132, 133 which preferably comprise a Warner linear actuator (12 vdc) 4" stroke, #D12-05A5-04 p/no. 9205-103-007. These actuators lift and lower the assembly including the lateral operating means 84, 86, sensors 102, 104, 130, 132, projecting members 72, 74 and rollers 76, 78 relative to mounting plates 134, 135 by means of a projecting pistons 136, 137 which are provided with anti-friction slides or bearing members 138, 139.

Referring to FIGS. 10 and 11, the motor 110 preferably comprises a "SLO-SYN" motor 120 volt, 0.8 amp, 60 hertz, 420 oz.-in. torque, 72 rpm, Superior Electric type #SS421CT. Also shown in FIG. 11 are additional proximity sensors 140 and 142 which are used to determine the position of the flattening members 52, 54 and 52*a* and 54*a*. These sensors 140, 142 are also preferably "TURCK" proximity sensors-18 mm, #Bi5-G18-AP6X (10–30 vdc).

Figure 13:
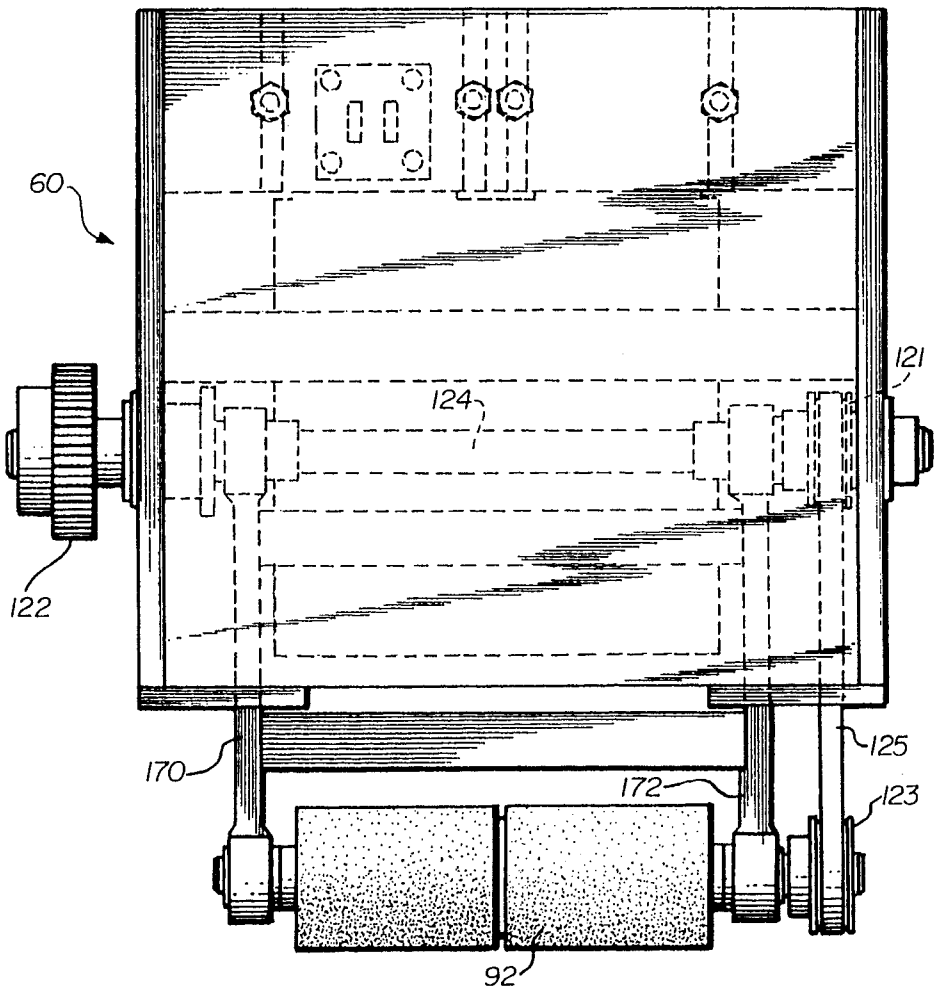
FIG. 13 is an enlarged side elevation of a portion of the apparatus of FIG. 10.
Figure 14:
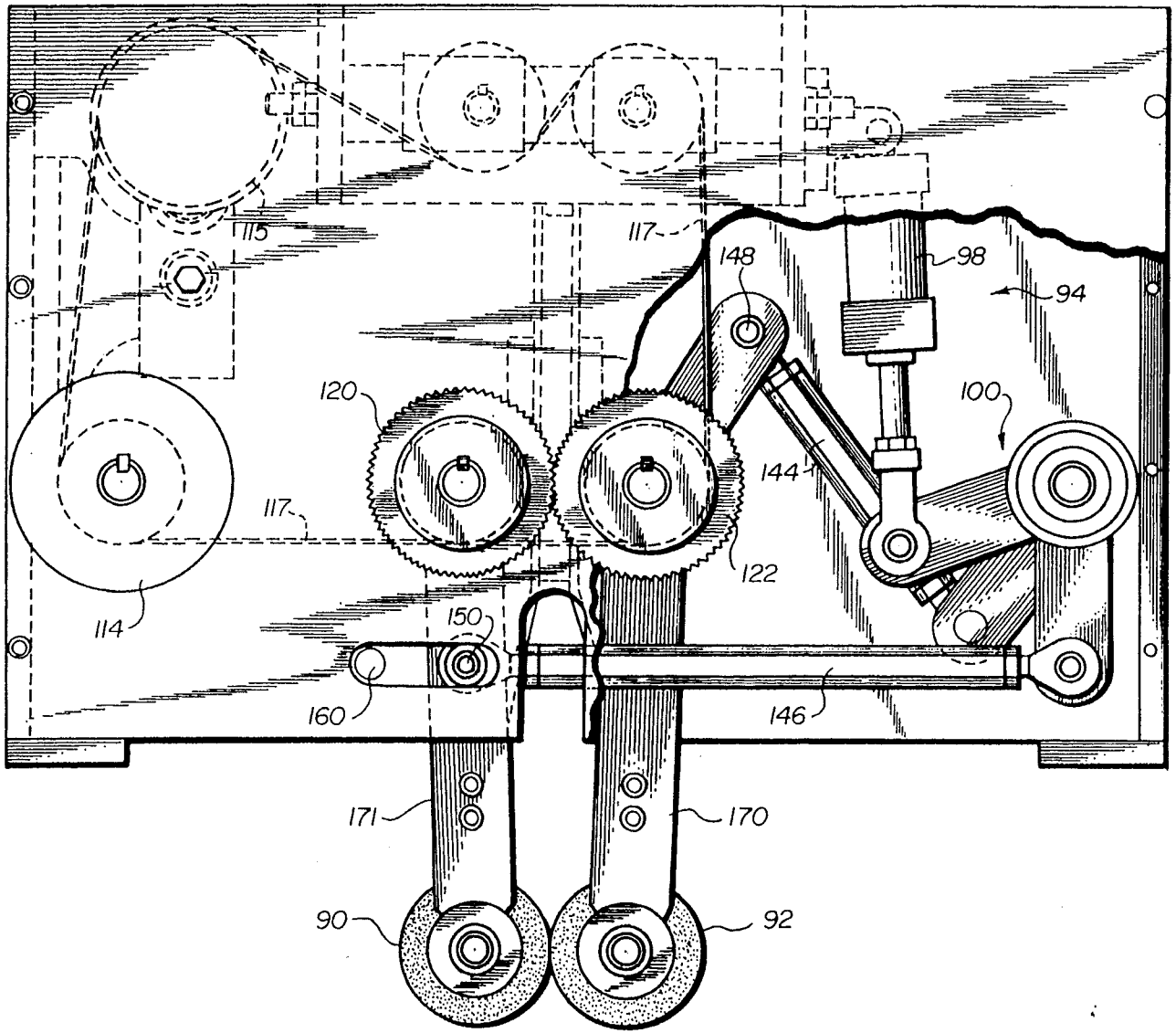
FIG. 14 is an enlarged elevation, partially broken away, of a portion of the apparatus of FIG. 10.

Referring now to FIG. 14, the linkage assembly 100 will be seen to be coupled via a pair of linkage arms 144, 146 to respective pivot points 148, 150. In this regard the rollers, 90, 92 are mounted to elongated struts 170–171 which are pivotally mounted at their opposite ends. The linkage arms 144, 146 are in turn driven by the piston and cylinder 98 through further pivot points and linkages 100 as indicated in FIG. 13. An additional proximity sensor 160 is provided for determining the relative position, that is pivoted out or pivoted inwardly relative to the bag, of the rollers 90, 92. This proximity sensor 160 is also preferably a "TURK" proximity sensor-18 mm, #Bi5-G18-AP6X (10–30 vdc).

Referring now to FIGS. 11, 13 and 14, the motor 110 drives the rollers 90 and 92 through intervening drive components as mentioned hereinabove. These components include sheaves or pulleys 112, 114, 115 and interconnecting drive belts 116, 117. Drive belt 117 is arranged to drive a pair of gears 120 and 122 which in turn are arranged to drive the rollers 90 and 92 in opposite directions of rotation. The gears 120 and 122 are connected by means of corresponding sheaves and belts, one set of which is illustrated in FIG. 13. As shown in FIG. 13, sheaves or pulleys 121 and 123 are interconnected by belt 125. Other idler C wheels for suitable adjustment are illustrated in FIG. 14. The gear 122 is mounted to a shaft 124 which at its opposite end mounts the sheaves or pulley 121. Mounted for free rotation about the shaft 124 are a pair of parallel depending arms 170, 172 which mount the roller 92 for pivotal motion in response to the action of the linkage assembly 100 and connecting arms 144, 146, as shown in FIG. 14. A similar pivot arm 171 which comprises the front mounting arm for roller 90 is also shown in FIG. 14.

In operation, the sequence is generally as follows. The rotary or carousel-type feeder or infeed device comes to a rest position between indexing movements, for example, when ends are being removed from the outfeed end 34 thereof. If the optional bag flattener devices are selected, during this rest or dwell period, the bag flattener devices 52 and 54 are activated to move inwardly and flatten the outwardly projecting ends 40 of the bags 35 in registry therewith, which the operator has previously pulled partially off of the ends by hand, as described hereinabove with reference to FIG. 3. The bag flatteners 52 and 54 are then returned laterally outwardly to the rest position. The rotary or carousel-type feeder device is then indexed again until those pockets 22 of the carousel feeder 20 from which project the bags whose ends have been flattened are positioned in registry with the bag removal rollers 90, 92.

If bag flatteners are not selected, the bags are indexed into registry with the rollers 90, 92 after their initial partial removal by hand. It will be noted in this regard that in the case of a dual station apparatus as illustrated in FIGS. 10–13, that the ends of bags in two adjacent pockets 22 will be removed simultaneously, and therefore, the rotary feed device will index until two bags are in registry or aligned with the rollers 90, 92 to proceed with the removal operation. In this regard, it should be noted that the rollers 90, 92 shown in FIGS. 10–14 are of sufficient axial length to simultaneously accomodate two bags projecting from adjacent ones of the pockets 22. If the flatteners 50 are selected for use, the rotary feed device will of course first index two bags into registry with the flatteners 52, 54 and 52*a*, 54*a* in the dual station apparatus of FIGS. 10–13, and thereafter index until two bags whose ends have been flattened are aligned with the rollers 90, 92.

Thereupon, the rollers 90, 92 are activated to close and grip the end of each bag, however, the rollers are not activated to rotate as this time. At the same time, the lateral operating means are activated to move the projecting members 72, 74 laterally inwardly to each bag. Thereupon the axial operating means 80 and 82 axially move the projecting members 72, 74 as necessary to locate the rollers 76, 78 immediately above and over the topmost end 57 of the stack of articles 45 within each bag 35. At this time, the motor 110 drive is activated and the rollers 90 and 92 begin rotating to remove the bag. When each bag has been fully removed, the motor 110 stops, pivot arms 152, 154 are pivoted apart, and the retaining members 72 and 74 are retracted laterally outwardly and lifted axially upwardly to their initial or rest position. Thereupon the rotary or carousel-type feeder or infeed device may again index to its next position. It will be appreciated that simultaneously with the removal of the bags by rollers 90, 92 subsequent bags may be flattened by the optional bag flatteners 52, 52*a* and 54, 54*a*, when selected for use.

While a particular embodiment of the invention has been shown and described in detail, it will be obvious to those skilled in the art that changes and modifications of the present invention, in its various aspects, may be made without departing from the invention, in its broader aspect, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A method for removing a bag from a stack of articles which are arranged in a facewise stacked condition in an elongate tubular bag, said stack defining an axial direction, said method comprising the steps of: engaging an axial end portion of said bag and drawing said bag in an axial direction for completely removing said bag from said stack of articles while simultaneously retaining said stack of articles in such a manner as to prevent axial movement thereof sufficient to disengage any of said articles from said stacked condition; wherein said step of retaining comprises pressing oppositely laterally inwardly upon said bag at an axial location just above a topmost end of said stack of articles with a force sufficient to hold said articles substantially in place during axial movement of said bag relative to said articles in a direction for removal while permitting said removal of said bag in an axial direction.

2. A method according to claim 1, and further including, prior to said step of engaging said axial end portion of said bag, pulling said bag at one end thereof in the axial direction until said axial end portion of said bag projects outwardly beyond said stack of articles.

3. A method according to claim 2 and further including, prior to said step of engaging of said axial end portion of said bag, compressing said axial end portion of said bag which projects outwardly beyond said stack of articles laterally inwardly to substantially flatten at least an axially outermost portion thereof.

4. A method according to claim 2, and further including, prior to said pulling step, opening an end of said bag opposite said one end, in the event said opposite end is closed.

5. A method according to claim 1 wherein said step of retaining comprises retaining said articles in said stack by applying a retaining force to a topmost end of said stack sufficient to prevent said articles from moving out of said facewise stacked condition while permitting motion of said bag in a direction for removal.

6. A method according to claim 1 wherein said step of retaining comprises engaging a topmost end of said stack of articles through said bag and holding said topmost end of said stack of articles in said facewise stacked condition while said bag is being removed while also permitting motion of said bag in a direction for removal.

7. Apparatus for removing a bag from a stack of articles which are arranged in a facewise stacked condition in an elongate tubular bag, said stack defining an axial direction, said apparatus comprising: bag removal means for engaging said bag at one end thereof and drawing said bag in an axial direction until said bag is removed from said stack of articles; and article retaining means for engaging said articles so as to prevent axial movement thereof sufficient to disengage any of said articles from said stacked condition during operation of said bag removal means for removing said bag from said stack of articles; wherein said article retaining means comprises means for pressing oppositely laterally inwardly upon said bag at an axial location just above a topmost end of said stack of articles with a force sufficient to hold said articles substantially in place during axial movement of said bag relative to said articles in a direction for removal while permitting said removal of said bag in an axial direction.

8. Apparatus according to claim 7 wherein said bag is initially axially moved relative to said stack of articles such that an axial end portion of the bag projects beyond the stack of articles, and further including bag flattener means for engaging and compressing a projecting axial end portion of said bag laterally inwardly to substantially flatten the same, prior to engagement thereof by said bag removal means.

9. Apparatus according to claim 8 wherein said bag removal means comprise a pair of rollers, movable mounting means for mounting said rollers for bi-directional movement in a generally lateral direction between a first position wherein the rollers are laterally spaced apart and a second position for engaging said bag therebetween, and drive means for rotating said rollers in a direction for propelling said bag axially in a direction for removal thereof from said stack of articles.

10. Apparatus according to claim 7, wherein said bag is initially axially moved relative to said stack of articles such that an axial end portion of the bag projects beyond the stack of articles, and wherein said article retaining means comprises a pair of oppositely inwardly projecting members and axial operating means for moving said members bi-directionally in the axial direction between a rest position and a location just above a topmost end of said stack.

11. Apparatus according to claim 10 and further including lateral operating means for moving said inwardly projecting members laterally inwardly and outwardly relative to said articles between a rest position and a position at least partially overlying said topmost one of said articles, such that when said projecting members are located by said axial operating means just above a topmost end of said stack of articles, said lateral operating means move said inwardly projecting members laterally inwardly.

12. Apparatus according to claim 10 and further including rollers mounted at facing ends of said inwardly projecting members for facilitating movement of said bag relative thereto in said axial direction.

13. Apparatus according to claim 9 and further including sensing means for sensing the axial location of a topmost end of said articles in said stack and producing a corresponding control signal and wherein said axial operating means is responsive to said control signal for moving said inwardly projecting members to an axial location just above said topmost end of said stack of articles.

14. Apparatus according to claim 7 wherein said bag removal means comprise a pair of rollers, movable mounting means for mounting said rollers for bi-directional movement in a generally lateral direction between a first position wherein the rollers are laterally spaced apart and a second position for engaging said bag therebetween, and drive means for rotating said rollers in a direction for propelling said bag axially in a direction for removal thereof from said stack of articles.

15. Apparatus according to claim 14 wherein said mounting means comprises a bi-directional drive means and linkage means for coupling said bi-directional drive means for pivoting said rollers between said first and second positions.

16. Apparatus according to claim 14 wherein said drive means comprise motor means and belt means operatively engaging said motor means and said rollers.

17. Apparatus for removing a bag from a stack of articles which are arranged in a facewise stacked condition in an elongate tubular bag, said stack defining an axial direction, said apparatus comprising: bag removal means for engaging said bag at one end thereof and drawing said bag in an axial direction until said bag is removed from said stack of articles; and article retaining means for engaging said articles so as to prevent axial movement thereof sufficient to disengage any of said articles from said stacked condition during operation of said bag removal means for removing said bag from said stack of articles; wherein said bag is initially axially moved relative to said stack of articles such that an axial end portion of the bag projects beyond the stack of articles, and wherein said article retaining means comprises a pair of oppositely inwardly projecting members and axial operating means for moving said members hi-directionally in the axial direction between a rest position and a location just above a topmost end of said stack.

* * * * *